US009321157B2

(12) United States Patent
Yang

(10) Patent No.: US 9,321,157 B2
(45) Date of Patent: Apr. 26, 2016

(54) WRENCH

(71) Applicant: Cheng-Pu Yang, Taichung (TW)

(72) Inventor: Cheng-Pu Yang, Taichung (TW)

( * ) Notice: Subject to any disclaimer, the term of this patent is extended or adjusted under 35 U.S.C. 154(b) by 401 days.

(21) Appl. No.: 14/074,702

(22) Filed: Nov. 7, 2013

(65) Prior Publication Data

US 2015/0122087 A1 May 7, 2015

(51) Int. Cl.
*B25B 23/00* (2006.01)
*B25B 13/46* (2006.01)

(52) U.S. Cl.
CPC ..... *B25B 23/0028* (2013.01); *B25B 13/46* (2013.01)

(58) Field of Classification Search
CPC ..... B25B 13/46; B25B 23/0028
See application file for complete search history.

(56) References Cited

U.S. PATENT DOCUMENTS 7,278,342 B1 * 10/2007 Chang ..... B25B 15/001 81/177.75
8,186,248 B1 * 5/2012 Considine ..... B25B 23/0021 81/177.3
8,205,529 B1 * 6/2012 Laurie ..... B25B 13/463 81/177.85
2004/0231472 A1 * 11/2004 Lin ..... F16C 11/045 81/177.8
2009/0000430 A1 * 1/2009 Wu ..... B25B 23/0028 81/177.8
2010/0107828 A1 * 5/2010 Huerta ..... B25B 13/461 81/177.9
2013/0139659 A1 * 6/2013 Yang ..... B25B 23/0028 81/460
2014/0123817 A1 * 5/2014 Lin ..... B25B 13/04 81/63.1
2014/0298957 A1 * 10/2014 Ragner ..... B25B 13/463 81/60
2015/0033916 A1 * 2/2015 Yang ..... B25B 23/0028 81/177.8

* cited by examiner

*Primary Examiner* — Joseph J Hail
*Assistant Examiner* — Marc Carlson

(57) ABSTRACT

A wrench includes a first part having a first pivotal portion, a first recess and a first hole, a second part having a second pivotal portion, a second recess and a second hole, and a third part which is received in the first and second recesses. The third part has third, fourth and fifth holes, and a control slot. A control unit is connected to the third part and has four urging members, two first acting members and a second acting member. The urging members are located in the third and fourth holes, and engaged with the first and second holes to pivotably connect the first and third parts, and the second and third parts. The first acting members are located in the fifth hole. The second acting member is located in the control slot and controls the first acting members to contact and the urging members or not.

6 Claims, 13 Drawing Sheets

WRENCH

FIELD OF THE INVENTION

The present invention relates to a wrench, and more particularly, to a wrench having a control unit which is located at the third part to allow the first, second and third parts to be connected to each other, or separated from each other.

BACKGROUND OF THE INVENTION

The conventional F-type wrench as shown in FIG. 17 and comprises a first part 61, a second part 62 and a pivot 63, wherein the first part 61 has a first pivotal portion 611 at the first end thereof and the first pivotal portion 611 has a first hole 612 transversely defined therethrough. The first part 61 has a ratchet gear pivotably connected thereto and the ratchet gear has a recess with a specific size. The second part 62 has a certain length so as to be held by the user, and a second pivotal portion 621 is connected to a first end thereof. The second pivotal portion 621 is a U-shaped portion and is pivotably connected to the first pivotal portion 611. The second pivotal portion 621 has a second hole 622 transversely defined therethrough which is located corresponding to the first hole 612. The second hole 622 has a threaded portion 623 therein. The pivot 63 extends through the first and second holes 612, 622 so that the first and second pars 61, 62 are pivotably connected to each other. Although the first and second pars 61, 62 are pivotable to each other, they cannot be separated from each other. Generally, the ratchet gear in the first part 61 has a specific size, and there are over thirty different sizes in the Metric system and the English system. If the manufacturers want to produce the wrenches to cover all of the different sizes, the number of the first and second parts 61, 62 will be significant, and this means the manufacturing cost is high. U.S. Pat. No. 7,036,403 discloses a wrench having the similar shortcoming.

The present invention intends to provide a wrench to improve the shortcomings mentioned above.

SUMMARY OF THE INVENTION

The present invention relates to a wrench and comprises a first part, a second part, a third part and a control unit. The first part has a first pivotal portion, a first recess and a first hole. The second part has a second pivotal portion, a second recess and a second hole. The third part is received in the first and second recesses. The third part has third, fourth and fifth holes, and a control slot which communicates with the fifth hole. The third hole is located corresponding to the first hole, and the fourth hole is located corresponding to the second hole. The fifth hole communicates with the third and fourth holes. The control unit is connected to the third part and has four urging members, two first acting member and a second acting member. The urging members are located in the third and fourth holes. The urging members are engaged with the first hole to pivotably connect the first and third parts. The urging members are engaged with the second hole to pivotably connect the second and third parts. The first acting members are located in the fifth hole. The second acting member is located in the control slot and controls the first acting members to contact and the urging members or not.

The primary object of the present invention is to provide a wrench wherein the first and third parts can be connected to each other or separated from each other, and the second and third parts can be connected to each other or separated from each other.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
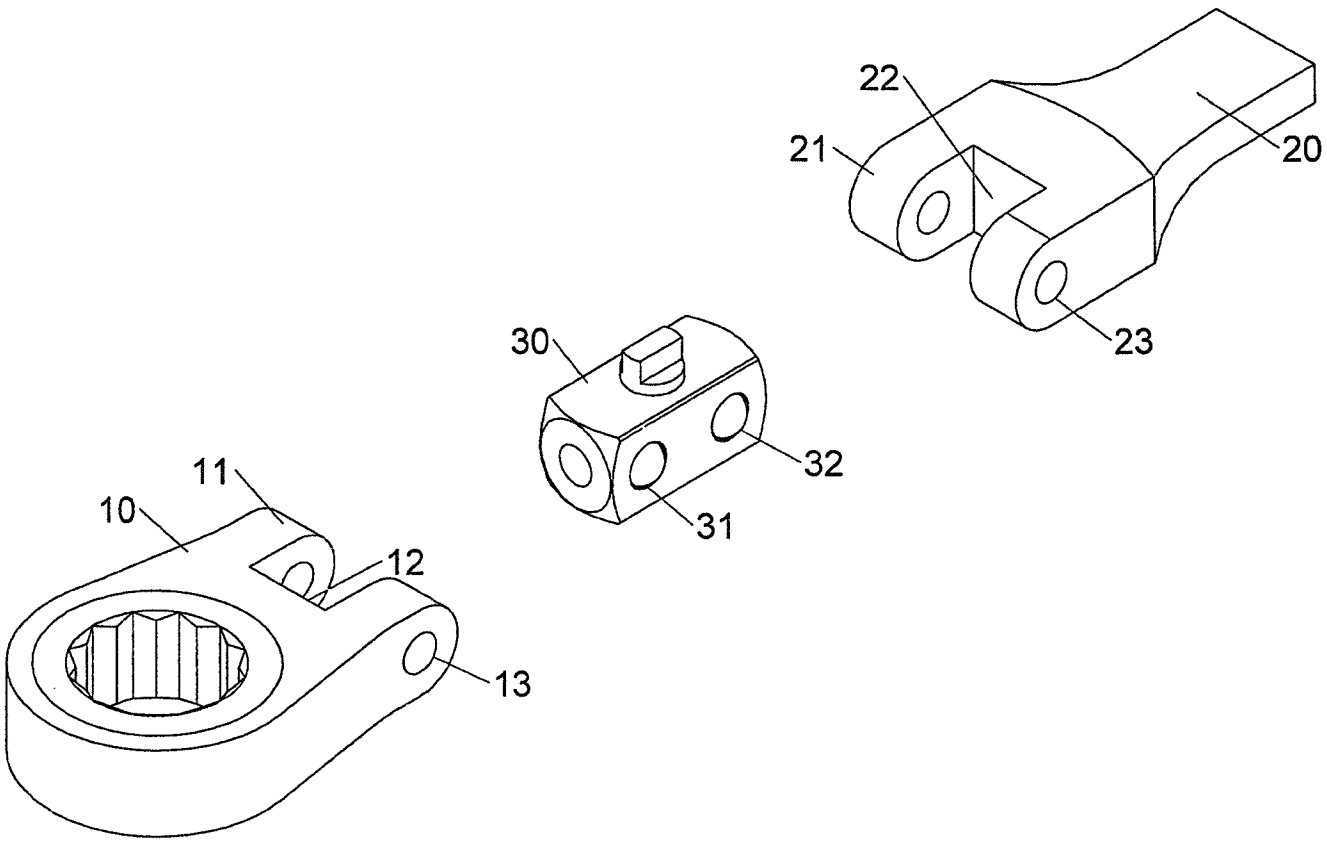
FIG. 1 is an exploded view of the wrench of the present invention.
Figure 2:
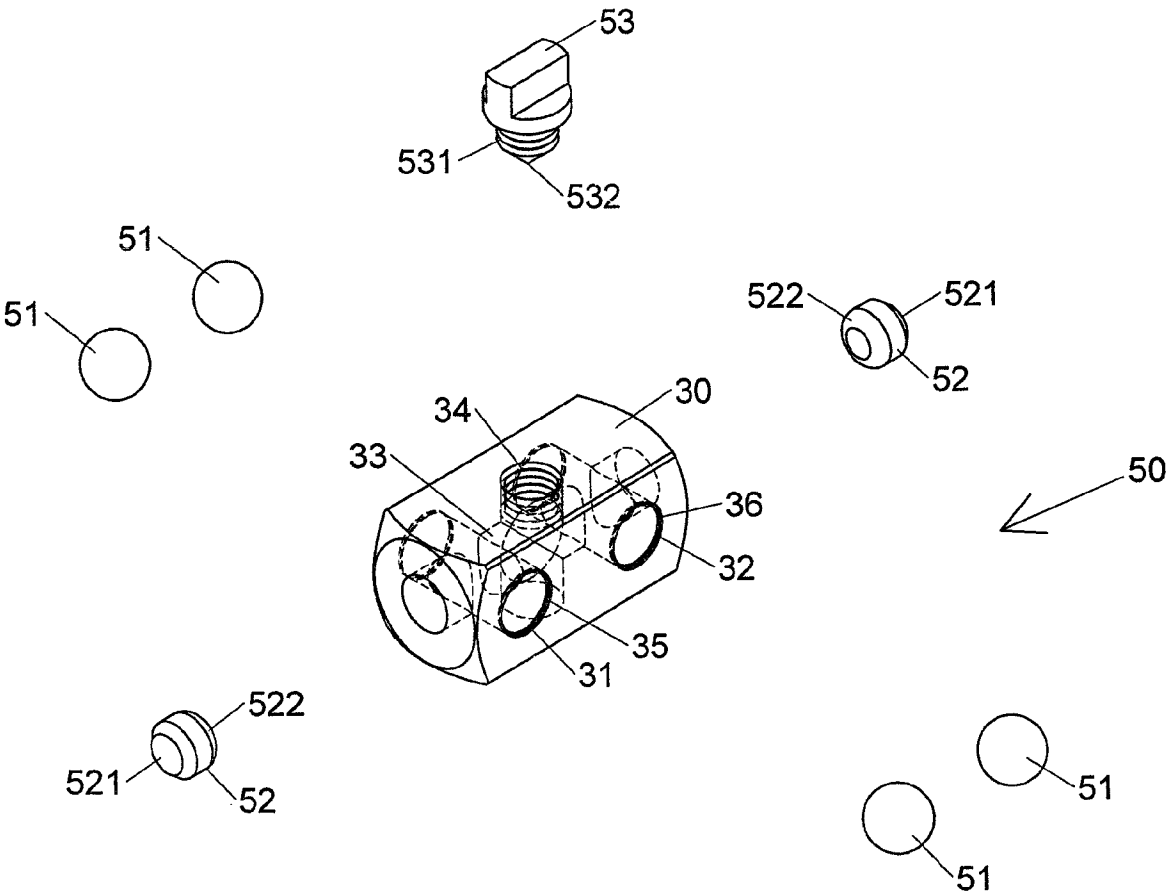
FIG. 2 is an exploded view of the third part and the control unit of the wrench of the present invention.

Referring to FIGS. 1 to 4, the wrench of the present invention comprises a first part 10 having a U-shaped first pivotal portion 11 on the first end thereof. A first recess 12 is defined in the first pivotal portion 11. A first hole 13 is defined through the first pivotal portion 11 transversely and communicates with the first recess 12. The first part 10 has a working end and a ratchet portion is pivotably connected to the working end so as to rotate an object.

A second part 20 has a certain length and is used as a handle and the user holds the second part 20 to rotate the wrench. A U-shaped second pivotal portion 21 is formed on the first end of the second part 20 and a second recess 22 is defined in the second pivotal portion 21. The second recess 22 is located corresponding to the first recess 12. The first and second recesses 12, 22 have the same width. A second hole 23 is defined through the second pivotal portion 21 transversely and communicates with the second recess 22. The first and second holes 13, 23 have the same diameter.

A third part 30 is a rectangular block and the first end of the third part 30 is received in the first recess 12 of the first part 10.

The second end of the third part 30 is received in the second recess 22 of the second part 20. The third part 30 has a third hole 31 defined through the first end thereof, and the third hole 31 is located corresponding to the first hole 13. The third hole 31 is larger than the first hole 13. The third part 30 has a fourth hole 32 defined through the second end thereof. The fourth hole 32 is located corresponding to the second hole 23 and larger than the second hole 23. The fourth hole 32 and the third hole 31 have the same diameter. The two respective axes of the third and fourth holes 31, 32 are parallel to each other, and a distance is defined between the two respective axes of the third and fourth holes 31, 32. The third part 30 has a fifth hole 33 defined therethrough and communicates with the third and fourth holes 31, 32. A control slot 34 is defined in the middle portion of one side of the third part 30, and has a threaded portion defined therein. The control slot 34 communicates with the fifth hole 33. A first restriction portion 35 is formed on each of two openings of the third hole 31 to reduce the diameter of the each opening of the third hole 31. A second restriction portion 36 is formed on each of two openings of the fourth hole 32 to reduce the diameter of the each opening of the fourth hole 32. The first and second restriction portions 35, 36 are formed by pressing the openings of the third and fourth holes 31, 32.

A control unit 50 is connected to the third part 30 and has four urging members 51, two first acting member 52 and a second acting member 53.

Figure 3:
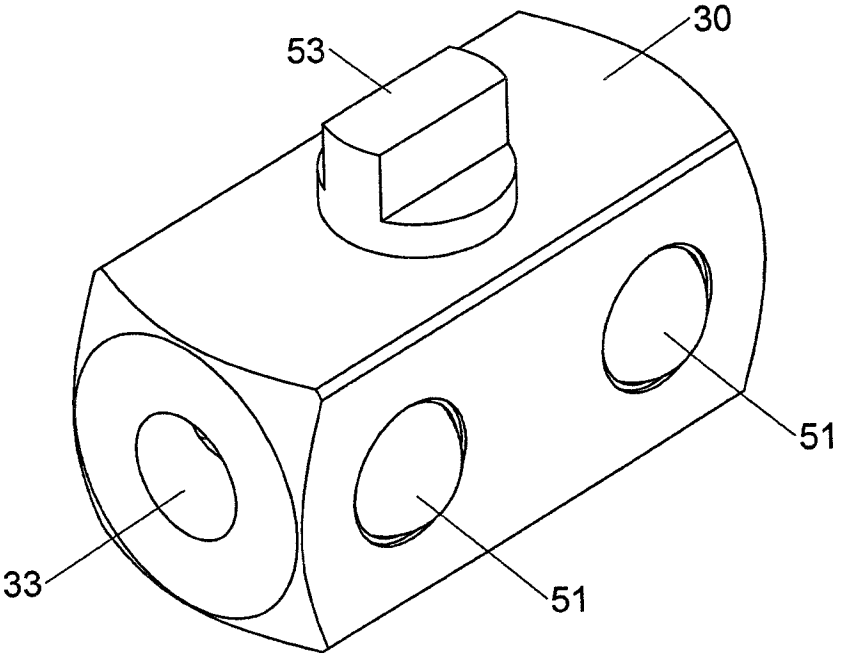
FIG. 3 is a perspective view to show the combination of the third part and the control unit of the wrench of the present invention.
Figure 4:
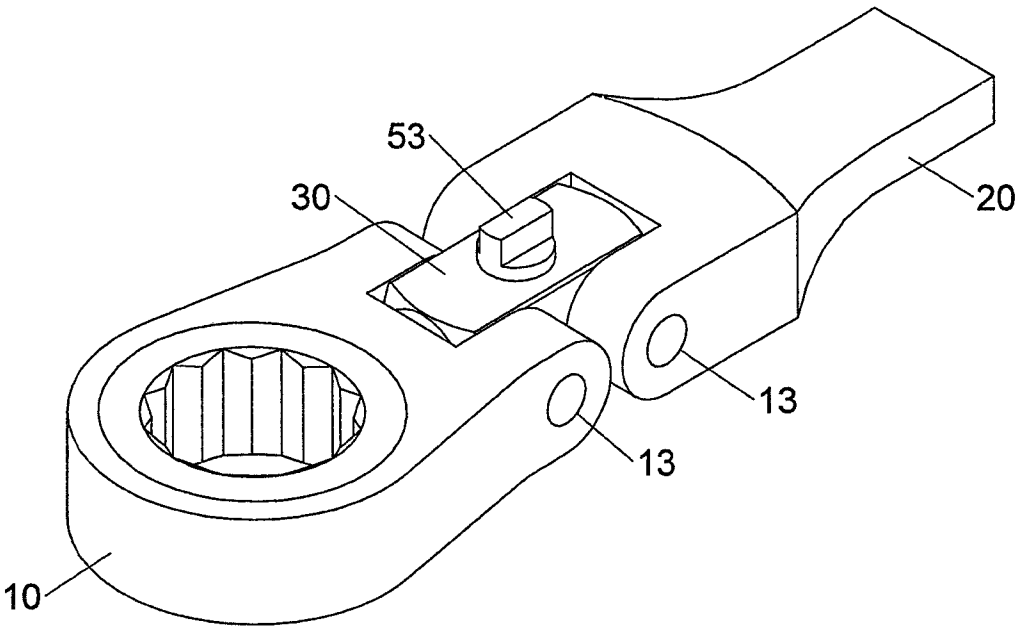
FIG. 4 is a perspective view to show the wrench of the present invention.
Figure 5:
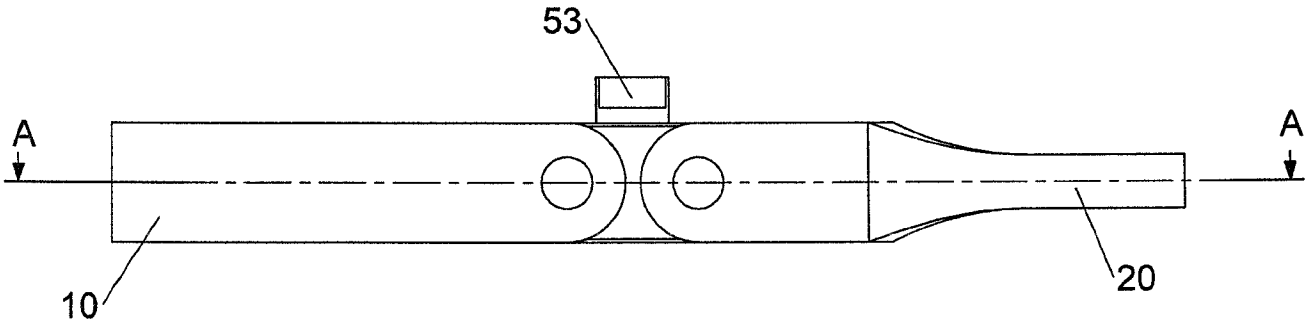
FIG. 5 is a side view of the wrench of the present invention.
Figure 6:
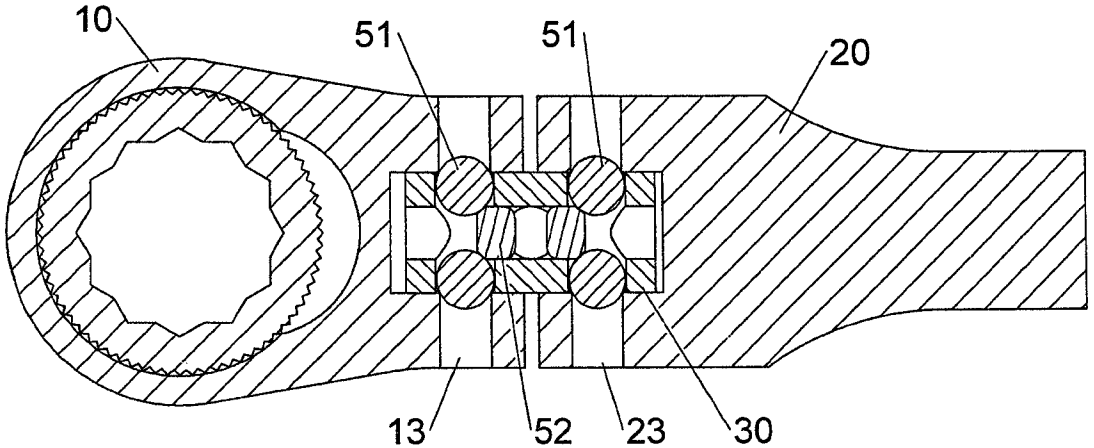
FIG. 6 is a cross sectional view, taken along line A-A in FIG. 5.
Figure 7:
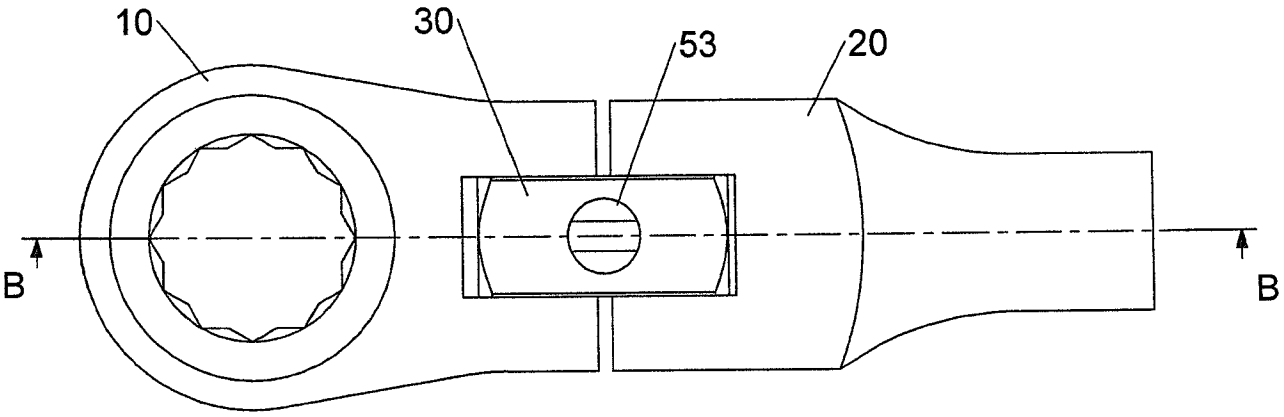
FIG. 7 is a top view of the wrench of the present invention.
Figure 8:
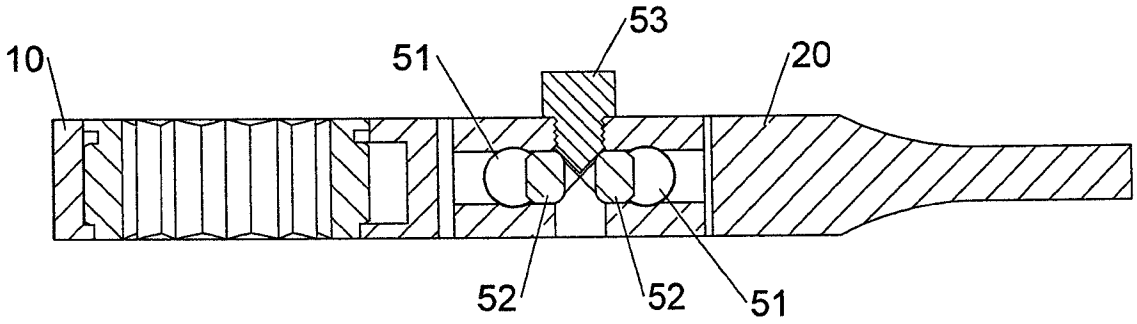
FIG. 8 is a cross sectional view, taken along line B-B in FIG. 7.
Figure 9:
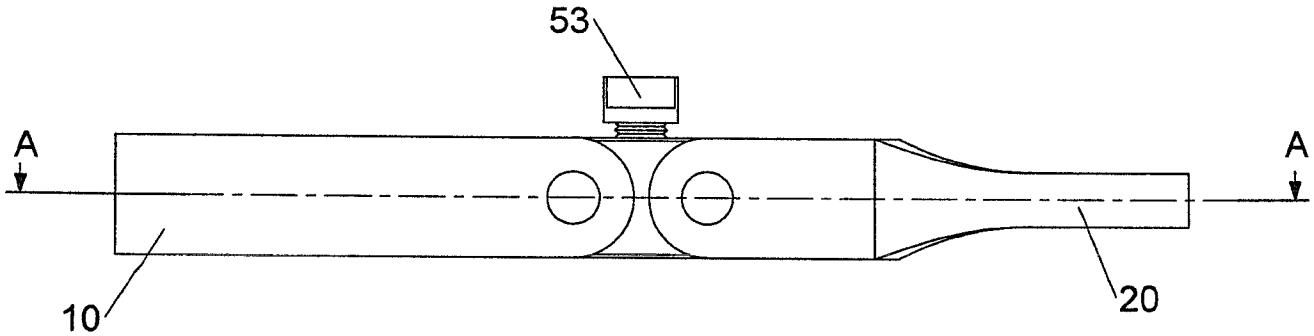
FIG. 9 is a side view to show the wrench of the present invention, wherein the second part is rotated.
Figure 10:
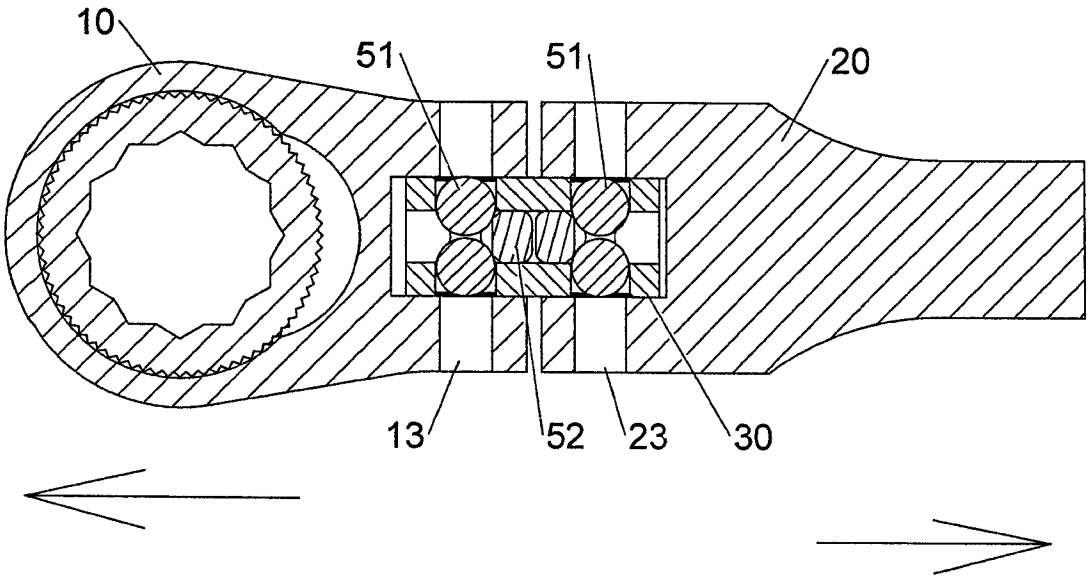
FIG. 10 is a cross sectional view, taken along line A-A in FIG. 9.

The urging members 51 are beads and are located in the openings of the third hole 31 and the four hole 32 of the third part 30. As shown in FIG. 3, the diameters of the first hole 13 of the first part 10 and the first restriction portion 35 are smaller than that of the urging members 51 so that the urging members 51 cannot be separated from the first hole 13. The periphery of each of the two urging members 51 in the first hole 13 are engaged with the openings of the first hole 13 so that the first part 10 is pivotably connected to the third part 30. The diameters of the second hole 23 of the second part 20 and the second restriction portion 36 are smaller than that of the urging members 51 so that the urging members 51 cannot be separated from the second hole 23. The periphery of each of the two urging members 51 in the second hole 23 are engaged with the openings of the second hole 23 so that the second part 20 is pivotably connected to the third part 30.

Each of the first acting members 52 is located in the fifth hole 33 and has a first contact portion 521 and a second contact portion 522. The first contact portions 521 contacts the urging members 51 respectively.

The second acting member 53 is partially rotatably located in the control slot 34 of the third part 30 and controls the movement of the first acting members 52 in the fifth hole 33 to contact the first acting member 52 against the urging members 51 or to keep the first acting member 52 at a distance from the urging members 51. The second acting member 53 has threads 531 which are threadedly connected to the control slot 34. The second acting member 53 has a third contacting portion 532 which contacts the second acting portion 522. The two first acting members 52 are located symmetrically relative to the second acting member 53.

As shown in FIGS. 5 to 8, the second acting member 53 is rotatably and threadedly connected to the control slot 34 of the third part 30, and the third contacting portion 532 contacts the second contacting portion 522 of the first acting members 52, so that the first contacting portion 521 of each of the first acting members 52 contacts the urging member 51 corresponding thereto. The two first acting members 52 contact the four urging members 51, and the urging members 51 protrude the third and fourth holes 31, 32 to engage with the first and second holes 13, 23. The first part 10 and the third part 30 are pivotably connected to each other, and the second part 20 and the third part 30 are pivotably connected to each other. When the second acting member 53 is rotated, the second acting member 53 is slightly unscrewed relative to the third part 30, the third contacting portion 532 of the second acting member 53 does not press the first acting members 52. There is a room for the first acting members 52 to move in the fifth hole 33. The first acting members 52 do not press the urging members 51, and the urging members 51 have room to move, so that the urging members 51 are separated from the first and second holes 13, 23. Therefore, the first, second and third parts 10, 20, 30 can be separated from each other. The first or second parts 10, 20 can be replaced, or the third part 30 or the parts of the control unit 50 can be replaced. This is the main advantage of the present invention.

Figure 11:
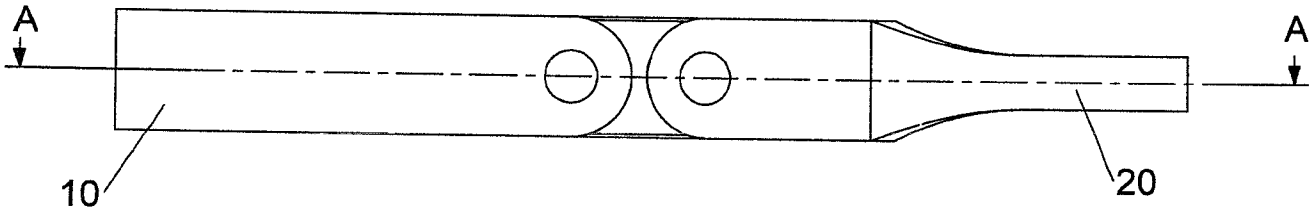
FIG. 11 is a side view to show the second embodiment of the wrench of the present invention.
Figure 12:
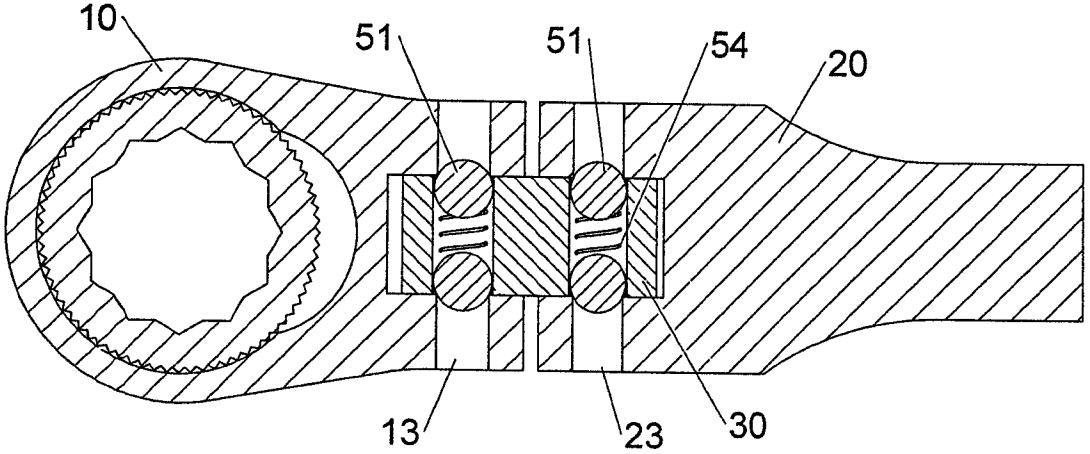
FIG. 12 is a cross sectional view, taken along line A-A in FIG. 11.

As shown in FIGS. 11 and 12, the third part 30 does not have the fifth hole 33 and the control slot 34, and the control unit 50 does not have the first and second acting members 52, 53. The control unit 50 has two resilient members 54 which are located in the third and fourth holes 31, 32. The resilient members 54 are biased between the urging members 51. When a force is applied to the first part 10 or the second part 20, the urging members 51 are disengaged from the first and second holes 13, 23, the first and third parts 10, 30 are able to be separated from each other, or the second and third parts 20, 30 are able to be separated from each other.

Figure 13:
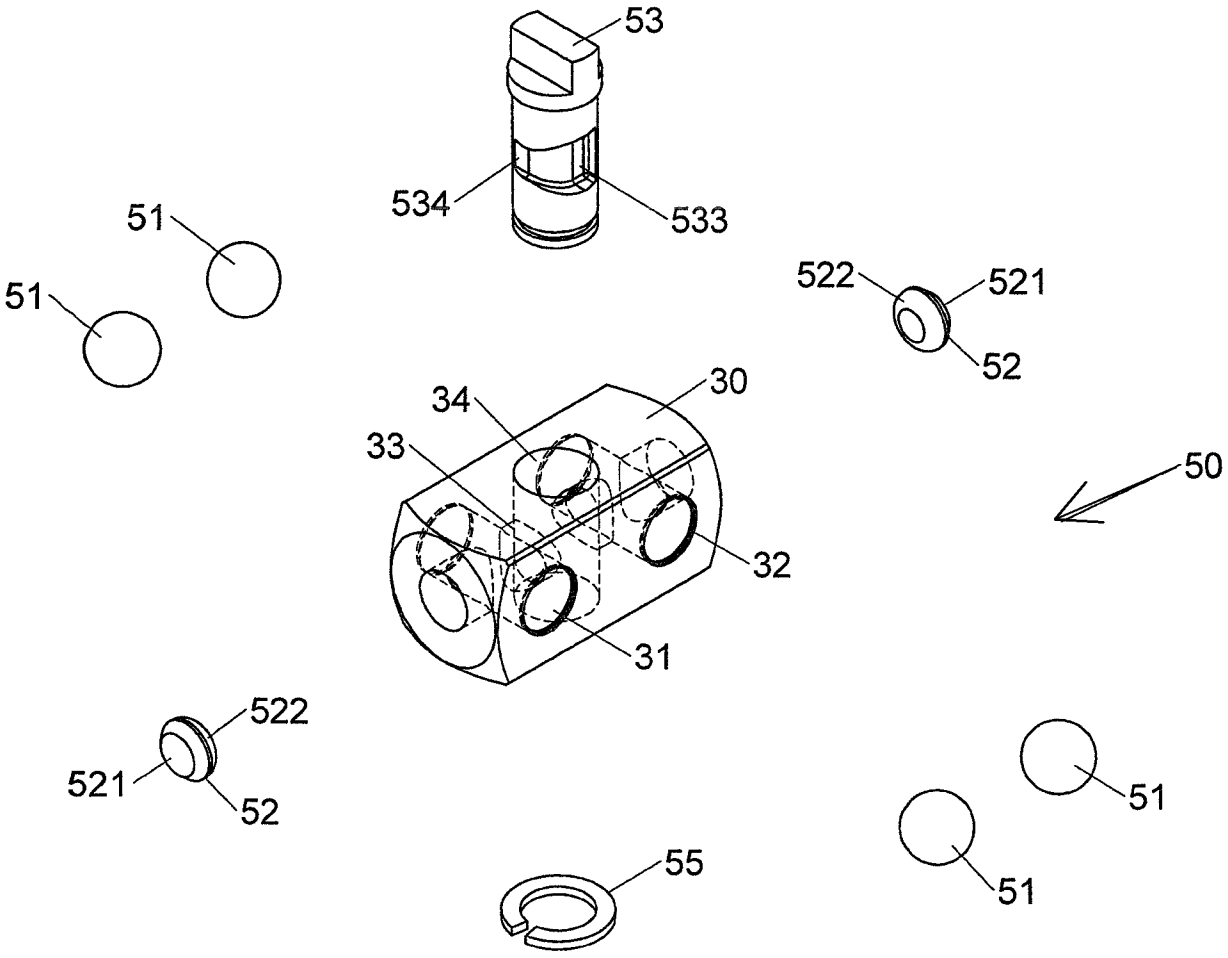
FIG. 13 is an exploded view of the third part and the control unit of the third embodiment of the wrench of the present invention.
Figure 14:
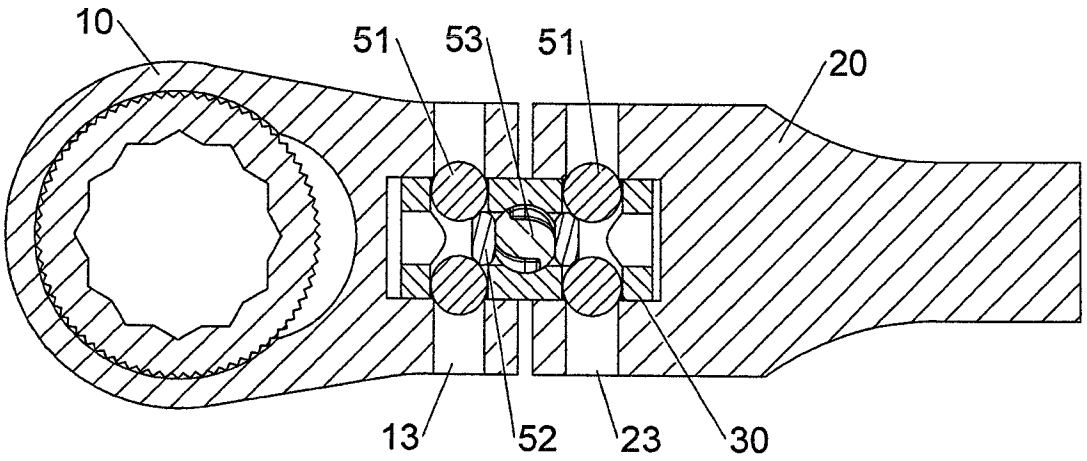
FIG. 14 is a cross sectional view of the third embodiment of the wrench of the present invention.

As shown in FIGS. 13 to 14, the second acting member 53 of the control unit 50 has a fourth contacting portion 533 and a fifth contacting portion 534 which is wider than the fourth contacting portion 533. The second acting member 53 does not have the threads 531 and the third contacting portion 532. The control unit 50 has a clip 55 which is connected to the second acting member 53 so as to pivotably connect the second acting member 53 to the control slot 34 of the third part 30. When the second acting member 53 is rotated, the fifth contacting portion 534 contacts the first acting members 52 to make the first acting members 52 contact against the urging members 51. The urging members 51 protrude from the first and second holes 13, 23 by the first acting members 52 so that the first, second and third parts 10, 20, 30 cannot be separated from each other. When the second acting member 53 rotates, the fourth contacting portion 533 is located corresponding to the two first acting members 52, the two first acting members 52 and the urging members 51 are movable so that the first and the third parts 10, 30 are able to be separated from each other, or the second and third parts 20, 30 are able to be separated from each other.

Figure 15:
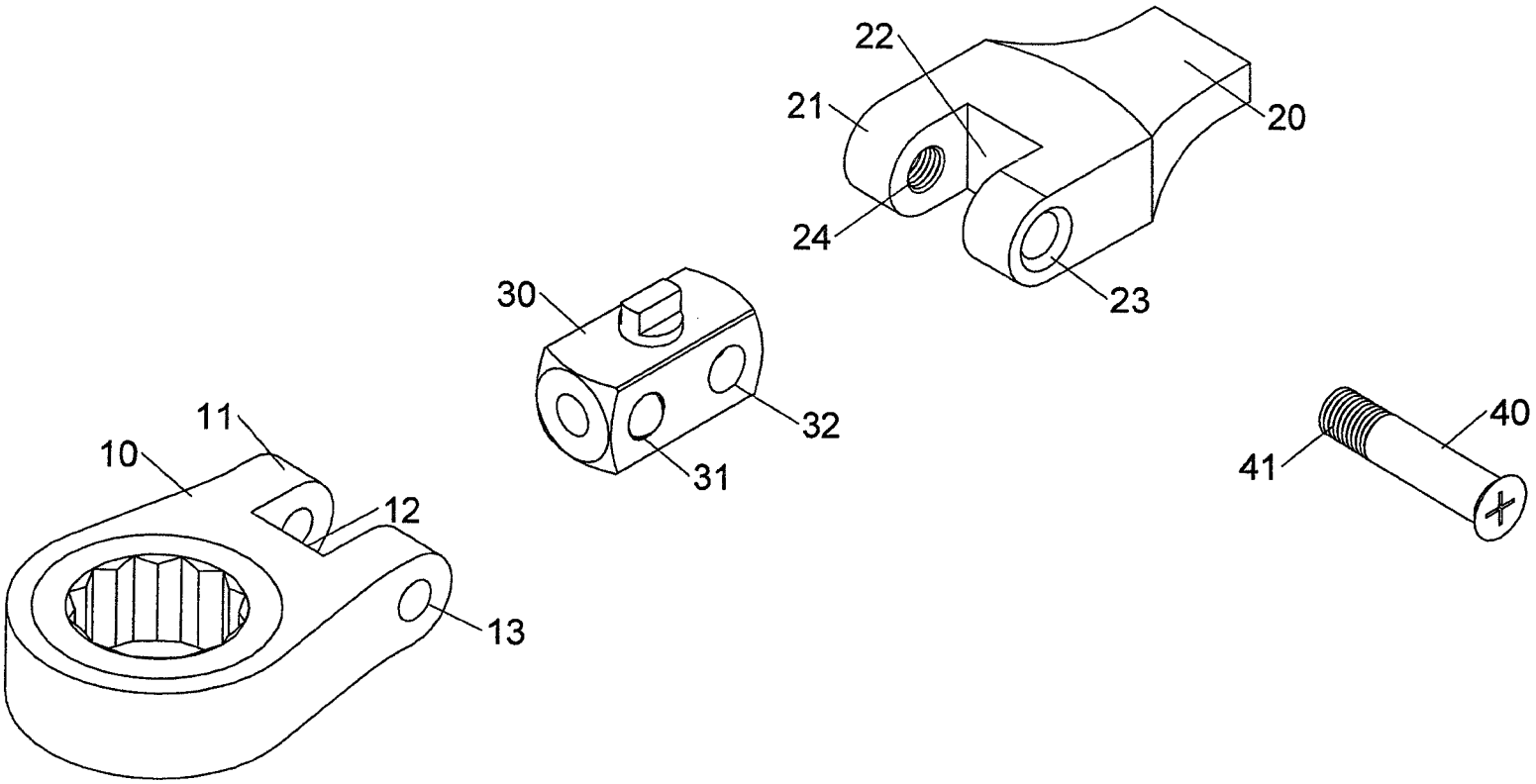
FIG. 15 is an exploded view of the fourth embodiment of the wrench of the present invention.

As shown in FIG. 15, the second hole 22 of the second part 20 has a second threaded portion 24, and there is a pivot 40 has a first threaded portion 41. The pivot 40 extends through the second hole 23 of the second part 20 and the fourth hole 32 of the third part 30, and the first threaded portion 41 is connected to the second threaded portion 24. The second part is pivotably connected to the third part 30. The operation of the second acting members 53 can only control the first and third parts 10, 30 to be connected to each other or to be separated from each other.

Figure 16:
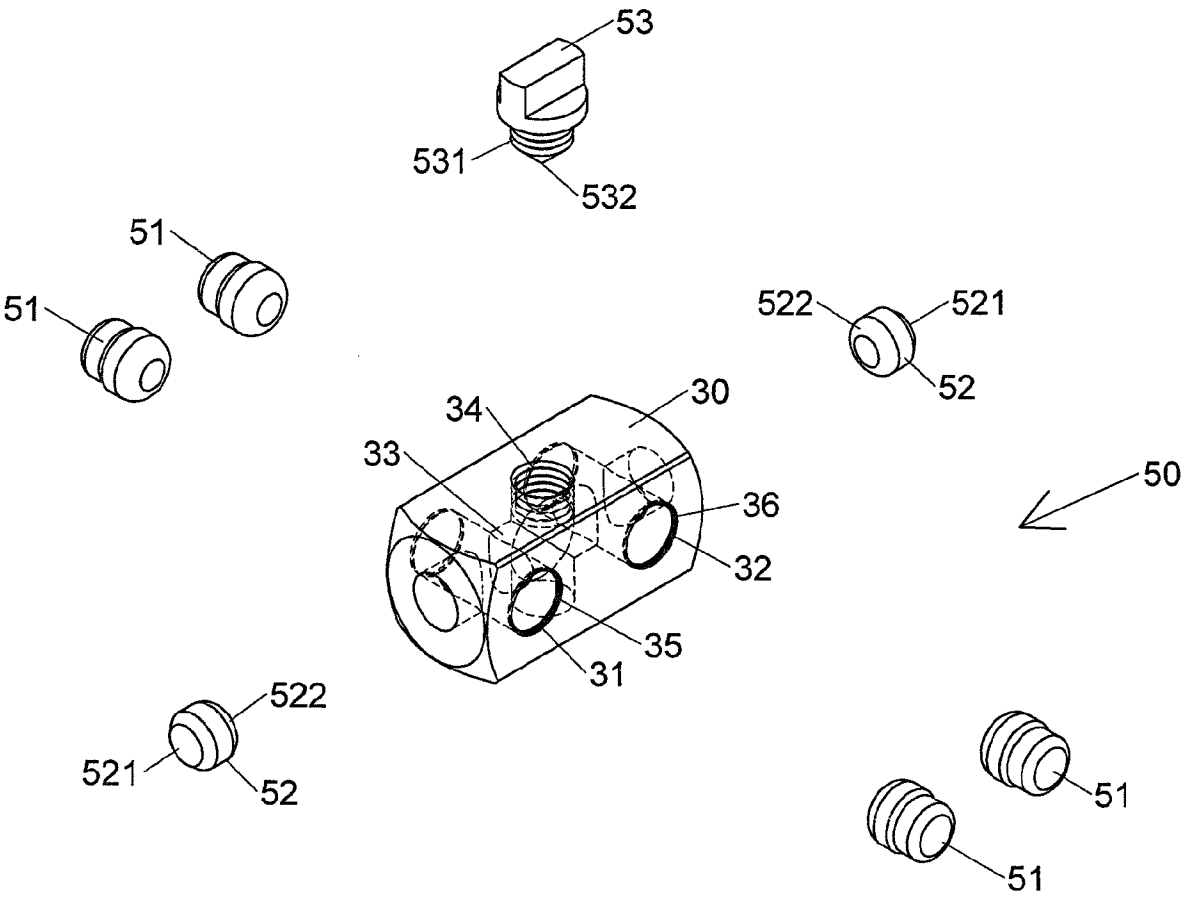
FIG. 16 is an exploded view of the third part and the control unit of the fifth embodiment of the wrench of the present invention.
Figure 17:
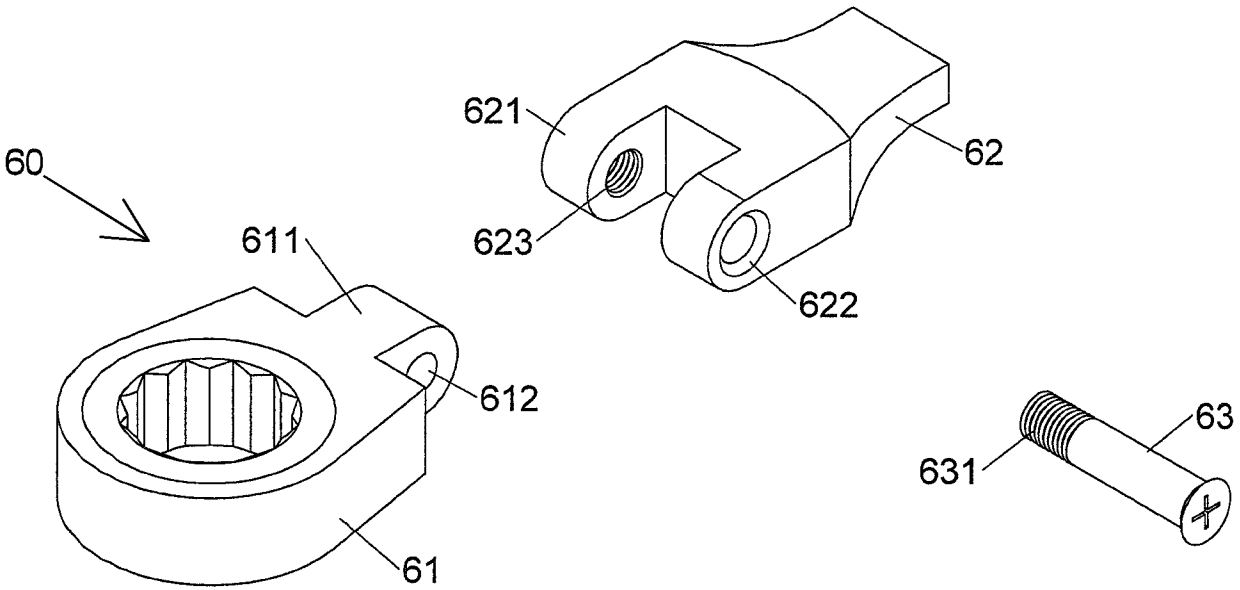
Prior Art FIG.17
FIG. 17 is an exploded view to show the conventional wrench.

FIG. 16 shows the third part 30 and the control unit 50, wherein the urging members 51 of the control unit 50 each are a stepped cylinder.

The first part 10 has a ratchet mechanism to rotate an object, and the first part 10 is an open end or closed end.

The advantages of the present invention are that when the second acting member 53 is operated, the first acting members 52 are activated and do not compress the urging members 52 so that the urging members 51 are separated from the first hole 13 and the second hole 23. The first part 10 and the third part 30 are able to be separated from each other, or the second part 20 and the third part 30 are able to be separated from each other. The first, second and third parts 10, 20, 30 can be separated from each other. The first or second parts 10, 20 can be replaced, or the third part 30 or the parts of the control unit 50 can be replaced.

The first and third parts 10, 30 are pivotably connected to each other, and the second and third parts 20, 30 are pivotably connected to each other, so that the first part 10 is able to be pivotable relative to the third part 30, and the second part 20 is able to be pivotable relative to the third part 30. The first and second parts 10, 20 are adjustable individually to meet different usage requirements when rotating an object.

In the third embodiment as disclosed in FIG. 13, the second acting member 53 of the control unit 50 has the fourth contacting portion 533 and the fifth contacting portion 534. When the second acting member 53 is rotated, the fifth contacting portion 534 contacts the first acting members 52, and the first acting members 52 contact against the urging members 51. The urging members 51 are engaged with the first and second holes 13, 23, so that the first, second and third parts 10, 20, 30 are pivotably connected to each other. In the third embodiment, when rotating the second acting member 53, the first and the third parts 10, 30 are able to be separated from each other, or the second and third parts 20, 30 are able to be separated from each other.

While we have shown and described the embodiment in accordance with the present invention, it should be clear to those skilled in the art that further embodiments may be made without departing from the scope of the present invention.

What is claimed is:

1. A wrench comprising:

a first part having a U-shaped first pivotal portion on a first end thereof, a first recess being defined in the first pivotal portion, a first hole being defined through the first pivotal portion transversely and communicating with the first recess;

a second part having a U-shaped second pivotal portion on a first end thereof, a second recess being defined in the second pivotal portion and located corresponding to the first recess, the first and second recesses having the same width, a second hole being defined through the second pivotal portion transversely and communicating with the second recess, the first and second holes having the same diameter;

a third part being a rectangular block and having a first end thereof received in the first recess of the first part, a second end of the third part being received in the second recess of the second part, the third part having a third hole defined through the first end thereof, the third hole being located corresponding to the first hole, the third hole being larger than the first hole, the third part having a fourth hole defined through the second end thereof, the fourth hole being located corresponding to the second hole and being larger than the second hole, the fourth hole and the third hole having the same diameter, two respective axes of the third and fourth holes being parallel to each other, a distance being defined between the two respective axes of the third and fourth holes, the third part having a fifth hole defined therethrough and communicating with the third and fourth holes, a control slot being defined in a middle portion of one side of the third part, and having a threaded portion defined therein, the control slot communicating with the fifth hole, a first restriction portion being formed on each of two openings of the third hole to reduce a diameter of the each opening of the third hole, a second restriction portion being formed on each of two openings of the fourth hole to reduce a diameter of the each opening of the fourth hole;

a control unit being connected to the third part and having four urging members, two first acting members and a second acting member;

the urging members being beads and located in the openings of the third hole and the four hole of the third part, two respective diameters of the first hole of the first part and the first restriction portion being smaller than that of the urging members so that the urging members cannot be separated from the first hole, a periphery of each of the two urging members in the first hole being engaged with the openings of the first hole so that the first part is pivotably connected to the third part, two respective diameters of the second hole of the second part and the second restriction portion being smaller than that of the urging members so that the urging members cannot be separated from the second hole, a periphery of each of the two urging members in the second hole being engaged with the openings of the second hole so that the second part is pivotably connected to the third part;

each of the first acting members being located in the fifth hole and having a first contact portion and a second contact portion, the first contact portions contacting the urging members respectively, and the second acting member being located in the control slot of the third part and controlling movement of the first acting members in the fifth hole to contact the first acting member against the urging members or to keep the first acting member at a distance from the urging members, the second acting member being rotatably located in the control slot, the second acting member having a third contacting portion which contacts the second acting portion, the two first acting members being located symmetrically relative to the second acting member.

2. The wrench as claimed in claim 1, wherein the first part has a working end which has a ratchet mechanism to rotate an object, or the first part is an open end or closed end.

3. The wrench as claimed in claim 1, wherein the first and second restriction portions are formed by pressing the openings of the third and fourth holes.

4. The wrench as claimed in claim 1, wherein the urging members of the control unit each are a stepped cylinder.

5. The wrench as claimed in claim 1, wherein the control slot has a threaded portion defined therein, and the second acting member has threads which are threadedly connected to the control slot.

6. The wrench as claimed in claim 1, wherein the second acting member of the control unit has a fourth contacting portion and a fifth contacting portion which is wider than the fourth contacting portion, the control unit has a clip which is connected to the second acting member to pivotably connected to the second acting member to the control slot of the third part, when the second acting member is rotated, the fifth contacting portion contacts the first acting members to make the first acting members contact against the urging members, the urging members protrude from the first and second holes by the first acting members so that the first, second and third parts cannot be separated from each other, when the second acting member rotates, the fourth contacting portion is located corresponding to the two first acting members, the two first acting members and the urging members are movable so that the first and the third parts are able to be separated from each other, or the second and third parts are able to be separated from each other.

* * * * *